US005476345A

United States Patent [19]

Papadopoulos

[11] Patent Number: 5,476,345

[45] **Date of Patent: * Dec. 19, 1995**

[54] SHORING SYSTEM: A LEDGER FRAME SHORING SYSTEM

[75] Inventor: Demetrios G. Papadopoulos, Hounslow, England

[73] Assignee: SGB Holdings Limited, Mitcham Surrey, England

[ * ] Notice: The portion of the term of this patent subsequent to Sep. 6, 2011, has been disclaimed.

[21] Appl. No.: 991,240

[22] Filed: Dec. 16, 1992

[30] Foreign Application Priority Data

Dec. 20, 1991 [GB] United Kingdom ..... 9127106

[51] Int. Cl.[6] ..... E02D 17/00

[52] U.S. Cl. ..... 405/272; 403/353

[58] Field of Search ..... 405/272, 282, 405/283; 403/49, 353, DIG. 4

[56] References Cited

U.S. PATENT DOCUMENTS

| | | | |
|---|---|---|---|
| 865,080 | 9/1907 | Candee | 405/280 |
| 968,450 | 8/1910 | Conking | 405/278 |
| 1,841,647 | 1/1932 | Smith | 403/329 X |
| 2,128,428 | 8/1938 | Murray | 405/278 |
| 2,932,481 | 4/1960 | Breer et al. | 248/354.6 |
| 3,362,167 | 1/1968 | Ward | 405/282 |
| 3,470,699 | 10/1969 | Cox | 405/282 |
| 3,688,508 | 9/1972 | Taylor | 405/278 |
| 3,901,609 | 8/1975 | Gostling | 403/49 |
| 3,902,326 | 9/1975 | Laugenbach | 405/230 X |
| 4,657,442 | 4/1987 | Krings | 405/282 |
| 4,907,675 | 3/1990 | Saby | 182/178 |
| 4,986,690 | 1/1991 | Cooksey | 403/353 X |
| 5,048,875 | 9/1991 | Usui et al. | 285/319 |

FOREIGN PATENT DOCUMENTS

| | | |
|---|---|---|
| 0049096A1 | 4/1992 | European Pat. Off. . |
| 0548541A1 | 6/1993 | European Pat. Off. . |
| 1399674 | 4/1964 | France . |
| 2633147A1 | 1/1978 | Germany . |
| 2633147 | 1/1978 | Germany . |
| 3102211A1 | 2/1980 | Germany . |
| 3102211 | 12/1981 | Germany . |
| 3641349A1 | 6/1988 | Germany . |
| 332026 | 7/1930 | United Kingdom . |
| 639129 | 6/1950 | United Kingdom . |
| 2234005 | 1/1991 | United Kingdom . |
| 2234776 | 2/1991 | United Kingdom . |

OTHER PUBLICATIONS

French Search Report dated Jul. 29, 1993.
European Search Report for Application No. EP 92 11 9719.
UK Search Report for Application No. GB 9127106.4.
UK Search Report for Application No. GB 9127107.2.
UK Search Report for Application No. GB 9207641.3.

*Primary Examiner*—David H. Corbin
*Attorney, Agent, or Firm*—Arnold, White & Durkee

[57] ABSTRACT

A shoring system consists of a number of vertical legs, with a ledger frame between each pair of adjacent legs. The ledger frame comprises an upper horizontally extending member and a lower horizontally extending member. There are vertical side members adjacent the sides of the frame. The horizontal members extend beyond the vertical side members and each horizontal member is provided with terminal connectors adapted to connect the horizontal members to the vertical legs. Consequently the vertical members on the ledger frame are spaced away from the vertical legs.

7 Claims, 5 Drawing Sheets

SHORING SYSTEM: A LEDGER FRAME SHORING SYSTEM

This application is the United States counterpart to the United Kingdom Application Serial No. 9127106.4, which was filed Dec. 20, 1991. Applicant claims the priority date of this foreign filing.

The present invention relates to a shoring system.

It has been proposed previously to propose a shoring system comprising extruded aluminium legs presenting a plurality of axially extending slots in the exterior of the leg, and ledger frames used to inter-connect the legs together to form the shoring system. One typical prior art system is disclosed in DE-A-3641349.

In this prior system ledger frames are provided consisting of upper members, and lower members which extend horizontally and two vertical side members. The vertical side members are adapted to be secured, by means of bolts, to the channels present in the shoring legs. The frames, as described above, may be braced with diagonally extending bracing elements.

One disadvantage of the prior proposed shoring system is that the vertical side members of the frames have to be made to be very strong, since all the load is transferred to the legs through the vertical side members. Also the vertical side members are bolted securely to the legs at positions which are spaced apart from the upper and lower horizontally extending members. If a ledger frame of the type described above is subjected to a shear force, with the top part of the frame being constrained to move in one direction in the plane of the frame and the lower part of the frame being constrained to move in the opposite direction, then a force is applied to the legs through the bolts securing the frames to the legs. Since these bolts are not located in alignment with the force, at the upper and lower limits of the frame, a mechanical advantage is exerted, by the direction, then a force is applied to the legs through the bolts securing the frames to the legs. Since these bolts are not located in alignment with the force, at the upper and lower limits of the frame, a mechanical advantage is exerted, by the frame, which may cause substantial bending in the vertical members. This may damage the vertical members. Also the connection between the frame and the vertical members may be damaged.

A further disadvantage of the prior art arrangement is that the frames cannot span across two leg sections which are joined axially together to make up a leg. The reason for this is that each leg section terminates with a plate, which has a greater dimension than the cross-section of the leg. If two legs are to be joined together co-axially, the plates are aligned and bolts are passed through the two plates, the bolts then being tightened to secure the plates together. Consequently, in the region where two legs are joined together, the plates protrude beyond the periphery of the legs, forming an outwardly extending projection. Since it is a member that forms the side of the frame that has to be secured to the vertical legs of the prior art system, it will be appreciated that this vertical member cannot be located adjacent the projection between two inter-connected legs, because the member must abut against one face of the leg over the entire length of the frame member. Consequently, in designing a shoring system using the prior proposed arrangement, there are various constraints as to where a ledger frame can be positioned.

The present invention seeks to provide an improved shoring system.

According to this invention there is provided a shoring system comprising at least two substantially vertical legs and at least one ledger frame extending between the legs, the ledger frame consisting of an upper horizontally extending member and a lower horizontally extending member, there being a vertical member adjacent one side of the frame and another vertical member adjacent the other side of the frame, the horizontal members extending beyond the vertical members and being provided with terminal connectors adapted to connect the horizontal members to the said vertical legs.

Preferably the said upper member and said lower member are both tubular, and each connector is mounted co-axially of the horizontal member to which it is connected.

Conveniently each connector comprises a spigot received within the end of the respective tubular member.

Advantageously each connector comprises a bolt, the bolt having a head dimensioned in one orientation to enter through a slot into a channel formed on a leg, and adapted to be moved to an alternative orientation in which it cannot be withdrawn from the channel, means being provided to move the bolt to the said alternative orientation and to urge the bolt into firm contact with the means defining the channel in the leg.

Conveniently each connector comprises an elongate housing to be mounted co-axially with the respective horizontal member, the housing defining a free end face and an axially extending bore, the bolt being received within the bore, means being provided adapted to engage the housing and the bolt, to move the bolt axially and to rotate the bolt.

Advantageously the means to rotate the bolt and move the bolt axially comprise a plate passing through a slot formed in the bolt, the plate having a slot formed therein, a pin extending diametrically of the bolt passing through the slot in the plate, the plate being rotatable about the axis of the housing to rotate the bolt and being movable, in at least one orientation, transversely of the housing, the slot in the plate being designed to move the bolt axially of the housing in response to such transverse movement of the plate.

DESCRIPTION OF THE FIGURES

In order that the invention may be more readily understood, and so that further features thereof may be appreciated, the invention will now be described, by way of example, with reference to the accompanying drawings in which.

Figure 1:
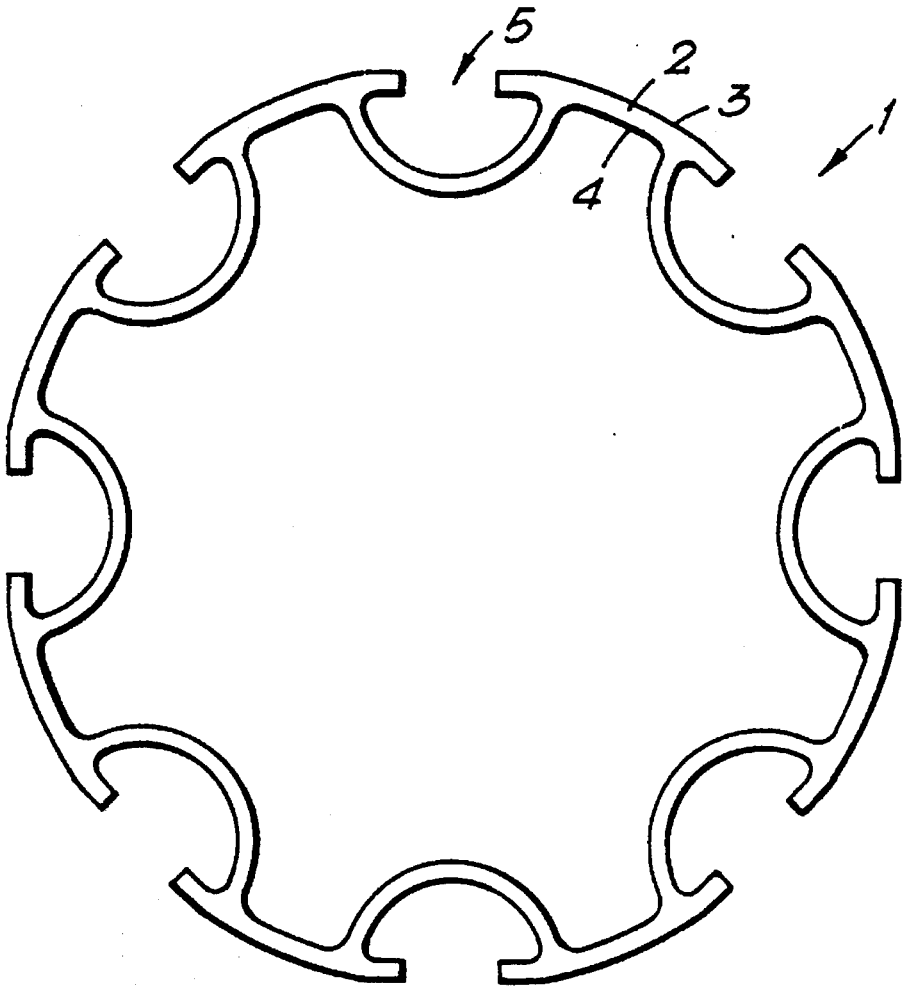
FIG. 1 is a cross-sectional view of an aluminium extrusion forming a shoring leg.
Figure 2:
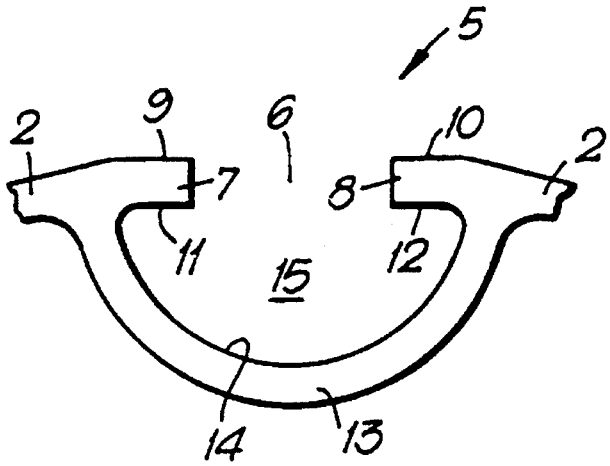
FIG. 2 is an enlarged view of part of FIG. 1, FIG. 3A, FIG. 3B, FIG. 3C, and FIG. 3D illustrate four types of frame which can be used with the leg of FIG. 1 and FIG. 2.
Figure 3A:
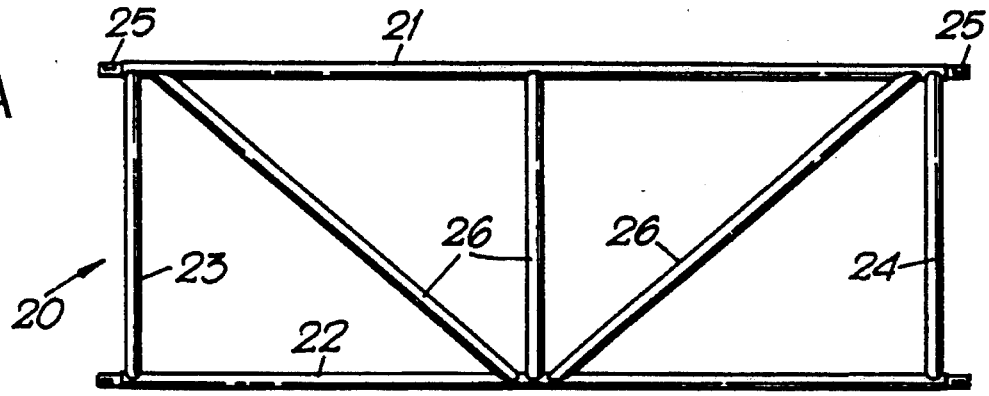
Figure 3B:
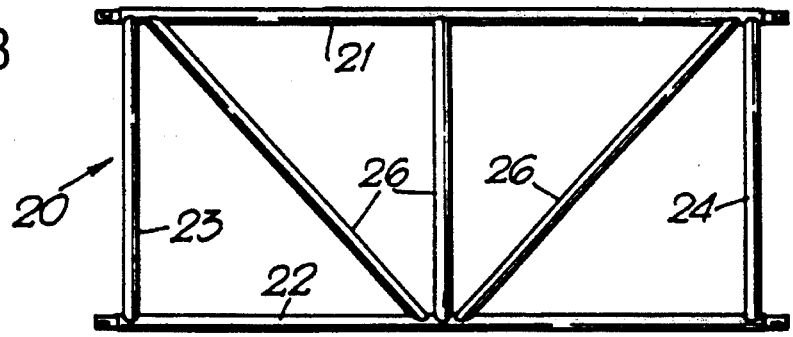
Figure 3C:
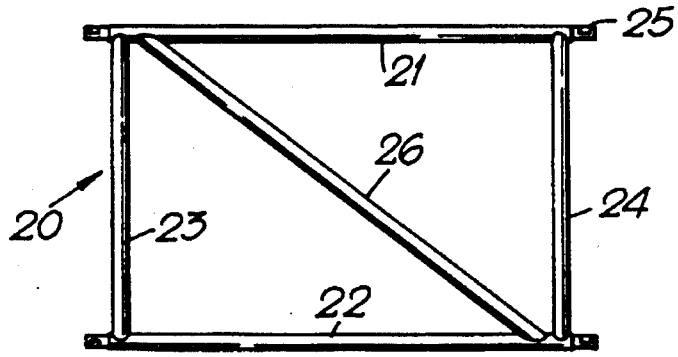
Figure 3D:
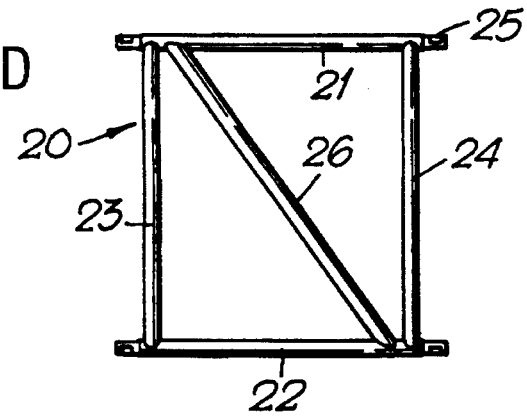

Referring initially to FIG. 1 and FIG.2 of the drawings, a shoring leg is formed of an extrusion 1 of aluminum. The extrusion comprises an outer wall 2 which has a circular outer surface 3 and a circular inner surface 4, thus defining a circular wall of uniform cross-section, the pipe being provided with a plurality of equi-angularly spaced slot formations 5.

FIG. 2 illustrates a typical slot formation 5 to an enlarged scale. In the region of each slot 5 the outer wall 2 of the extrusion is interrupted. Each slot formation 5 defines an open slot 6 which is located between two inwardly directed lips 7,8, the lips extending from the circular outer wall 2. The lips 7,8 present flat outer faces 9,10 which are co-aligned, the flat faces defining a plane which is perpendicular to the radius passing from the centre of the extrusion 1 to the centre of the slot 6. Thus the flat outer faces 9,10 of the lips 7,8 form a flat abutment surface against which an element to be connected to the extrusion may readily abut. The lips 9,10 also have flat co-aligned inner faces 11,12 which are parallel with the outer faces. These inner faces are designed to receive appropriate clamping means to enable items to be readily clamped to the leg.

Extending between the points on either side of the slot 6 where the lips 7,8 engage the outer wall 2 is a substantially semi-circular web 13. The web is inwardly directed, in that the web is located on the interior of the pipe defined by the wall 2, rather than on the exterior thereof. The inner surface 14 of the web 13 thus defines, together with the lips 7 and 8, a channel 15 which communicates with the slot 6, the channel 15 having a substantially semi-circular base defined by the face 14 of the web 13 and a substantially planar top defined by the surfaces 11 and 12 of the inwardly directed lips 7 and 8.

Referring now to FIG. 3A, FIG. 3B, FIG. 3C, and FIG. 3D in which a plurality of ledger frames are illustrated which can be used with the leg as described with reference to FIG. 1 and FIG. 2. In each case the same reference numerals will be used to describe each of the frames.

Each frame 20 consists of tubular metal components welded together in a conventional manner. The metal components may be fabricated of aluminium, aluminium alloy or some other metal.

Each frame consists of a horizontally extending upper member 21 and a horizontally extending lower member 22. The members 21 and 22 are intended to span the space between two vertical legs. Each frame is provided with two vertical side members 23,24. These members are not located at the ends of the upper and lower horizontal members 21,22 but are spaced inwardly slightly from the ends of the horizontal members. The end parts of the horizontal members are constituted by latches 25 to be described hereinafter in greater detail, adapted to engage the slots formed in the legs described above. The latches are in alignment with the respective horizontal members, so that any shear force experienced by the horizontal members ma be applied directly, in alignment with the horizontal members, to the vertical.

Figure 4:
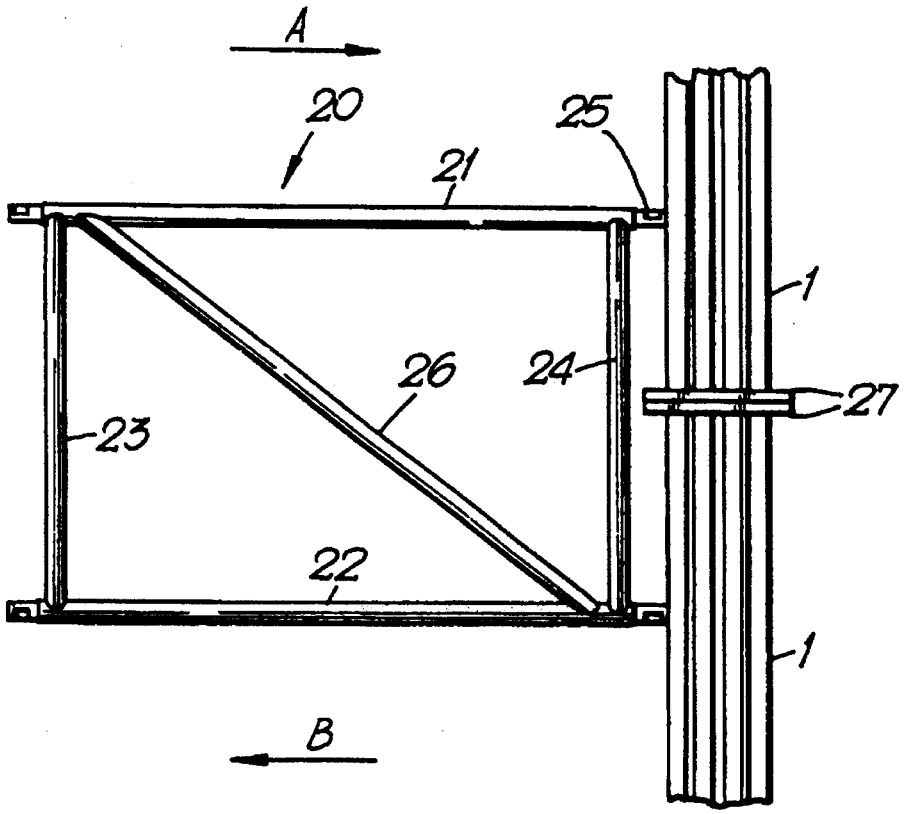
FIG. 4 illustrates part of a frame of FIG. 3 connected to a vertical shoring leg, the leg being formed of two interconnected leg sections.

It is to be appreciated that if a frame 20 such as that illustrated in FIG. 4 is subjected to a sheer force, with the upper part 21 moving in one direction, as indicated by the arrow A, and the lower part moving in the opposite direction as indicated by the arrow B, the resultant force will be applied directly to the legs by the connectors 25 which are co-aligned with the upper and lower elements of the frame. The connectors thus serve to transmit any force experienced by the frame directly to the leg without the frame acting to increase the force by applying a mechanical advantage to the force.

Each frame may be provided with one or more reinforcing members 26. The reinforcing members may extend diagonally or the reinforcing members may extend vertically, effectively dividing the frame into two regions, each region being provided with a diagonally extending reinforcing member. Other forms of reinforcement may be provided, although in some cases no reinforcement will be necessary.

FIG. 4 illustrates part of one of the frames of FIG. 3A, FIG. 3B, FIG. 3C and FIG. 3D connected to a vertical leg. The leg is formed from two sections of extrusion 1 as illustrated in FIG. 1 and FIG. 2, the leg sections each terminating with a connector plate 27. The connector plates are bolted together in a conventional manner. It can be seen that the connector plates 27 project horizontally outwardly beyond the envelope defined by the extrusions 1. However, because the vertical member 23 provided on the frame 20 is spaced inwardly from the ends of the horizontally extending portions 21,22, the frame 20 can be mounted with one connector 25 engaging the upper extrusion 1 and the lower connection 25 engaging the lower extrusion 1. It will thus be appreciated that the frame can be positioned virtually anywhere on a leg which comprises a plurality of interconnected extrusions 1. Of course, a connector 25 cannot be located precisely where the connector plates 27 are positioned, but the connector 25 can be located at any other position on the leg.

A connector 25 as used on a frame 20 as mentioned above will now be described in greater detail.

Figure 5:
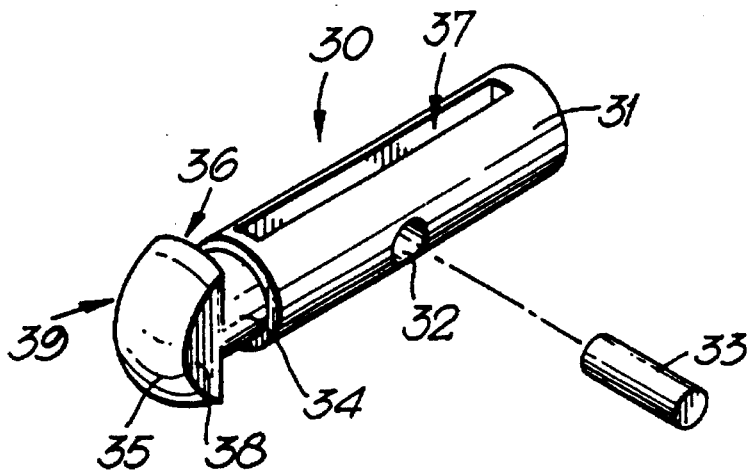
FIG. 5 is a perspective view of a bolt forming part of a catch mounted on a frame.

FIG. 5 illustrates a principal component of the connector 25, the component comprising a bolt 30. The bolt 30 comprises a main cylindrical body portion 31. The body portion 31 defines a transversely extending bore 32 dimensioned to receive a transversely extending pin 33. In the orientation of the bolt illustrated in FIG. 5 the bore 32 extends horizontally.

At one end of the cylindrical body portion 31 is a reduced diameter axially extending peg 34 which carries a head 35. A vertically extending axial slot 37 is provided which extends from a point adjacent the head 35, along the axis of the peg 34 and along the axis of the main body portion 31 of the bolt 30, to a point adjacent the free end of the bolt.

The head 35 is in the form of a hemisphere mounted on the peg 34, with the planar base 36 of the hemisphere extending perpendicularly to the axis of the peg 34. Two opposed sides of the hemisphere have been cut away to define two flat faces 38,39, the flat faces being parallel with each other and being spaced apart by a distance substantially equal to the diameter of the peg 34. It is to be understood that the head need not be precisely hemispherical, but may be only substantially hemispherical.

Figure 6:
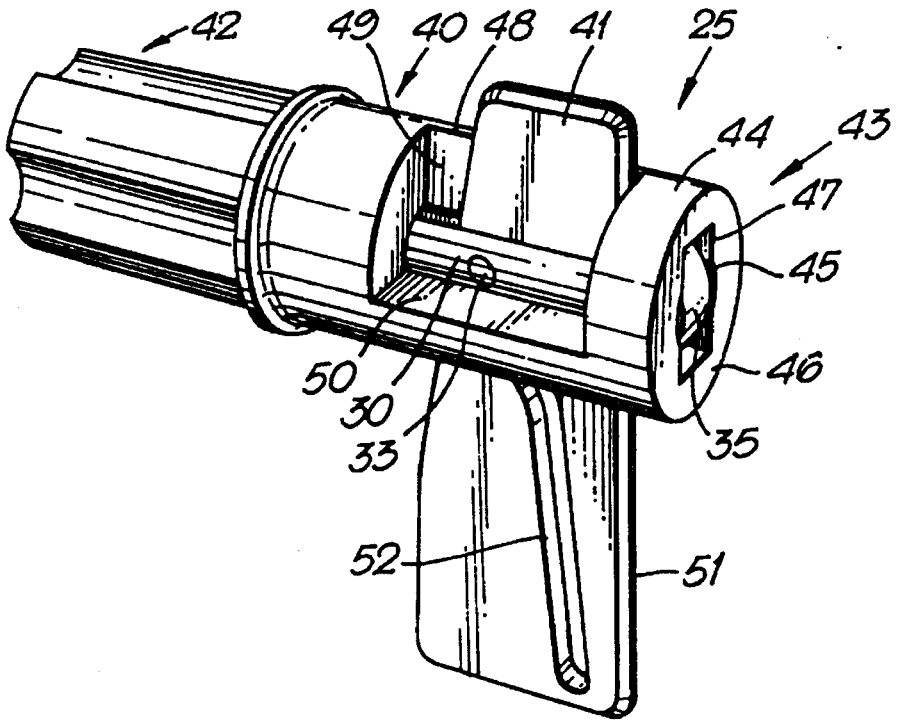
FIG. 6 is a perspective view of the catch in an initial condition.
Figure 7:
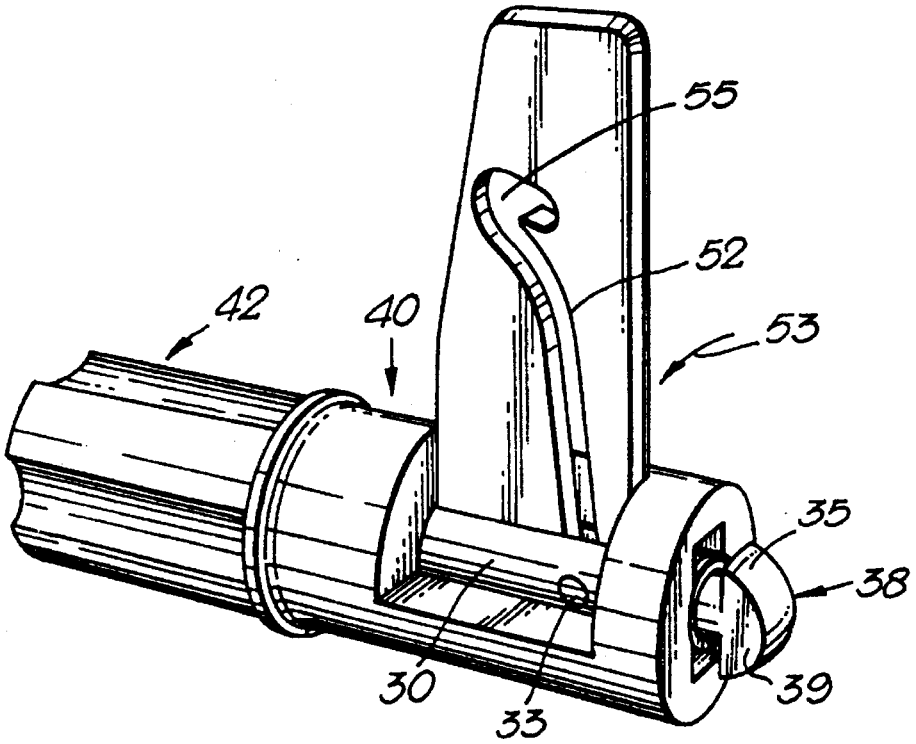
FIG. 7 is a perspective view of the catch in a second position.
Figure 8:
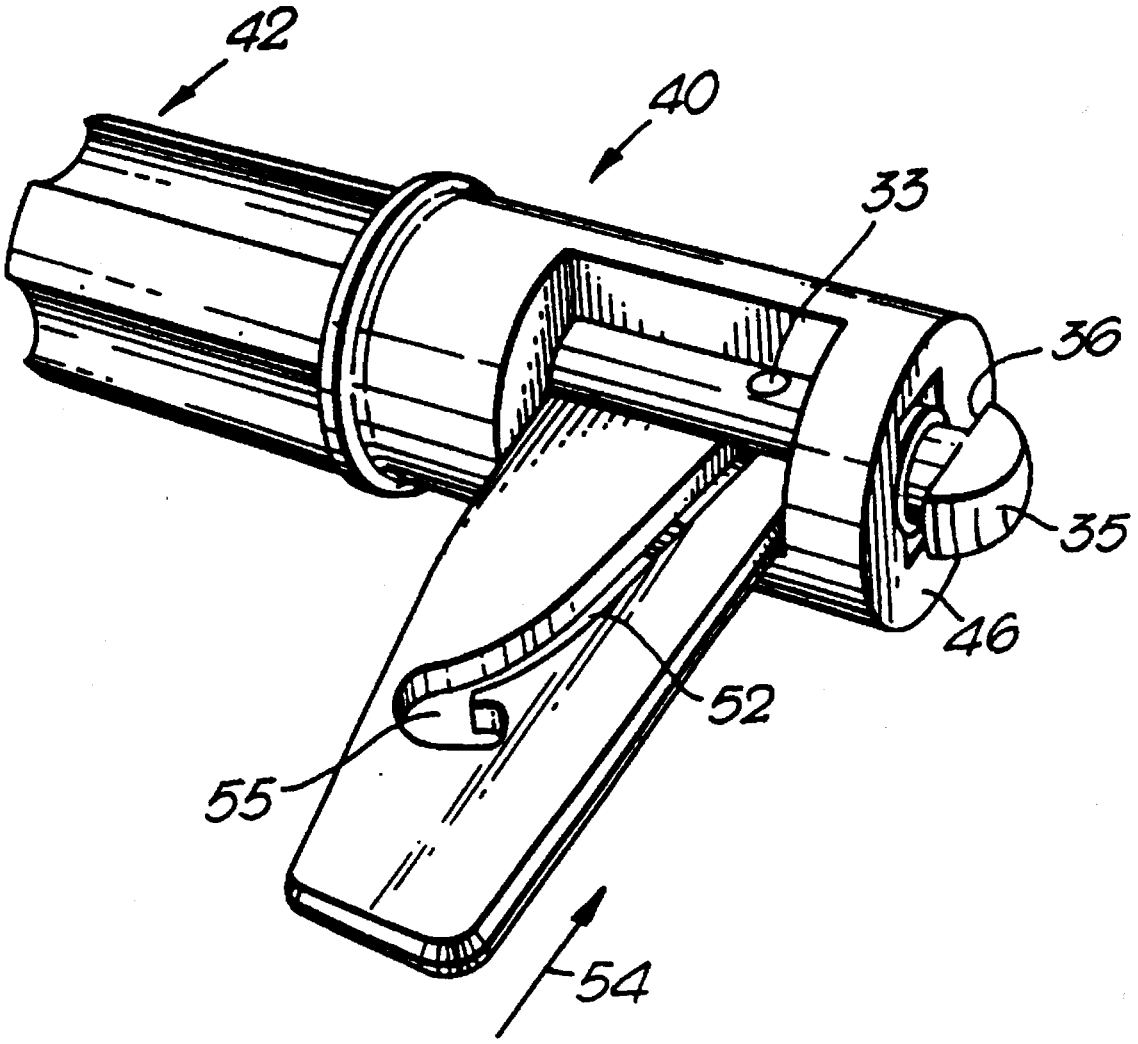
FIG. 8 is a view of the catch in a third position.

The bolt 30, as will now be described in greater detail with reference to FIGS. 6 to 8, is mounted in a housing which is connected to the frame 20, and the bolt 30 is adapted to be moved so that the head 35 of the bolt can be advanced towards a slot 6 as formed in the leg 1, with the faces 38,39 on the bolt in a vertical position so that the head 35 may be introduced through the slot 6 into a channel 15 as formed in the leg 1. The bolt is then adapted to be rotated through 90° so that the flat surface 36 provided on the head 35 can engage the flat faces 11 and 12 as defined by the lips 7 and 8 of the slot 6. The bolt is then adapted to be moved in a direction attempting to withdraw the bolt from the channel, so that the head 35 securely grips the channel 5.

Turning now to FIG. 6, FIG. 7 and FIG. 8 a latch 25 incorporating the bolt 30 of FIG. 5 is illustrated. The latch 25 comprises a casting 40, the bolt 30 (including the pin 33) and a wedge plate 41.

The casting 40 is elongate and generally cylindrical. One end 42 of the casting is a fluted spigot and is intended to be secured within one end of a tube such as the tube 21 or 22 forming one of the horizontal parts of the frame 20. The fluted spigot 42 of the casting 40 may be secured in position within the tube in any convenient way. The other end 43 of the casting presents a substantially cylindrical exterior 44 and defines an axially extending bore 45 which extends from the free end face 46 of the casting 40 axially towards the fluted end. In the end face 46 a rectangular recess 47 is formed dimensioned to receive the head 35 of the bolt 30.

The end portion 43 of the casting defines a cut-out 48 which extends from the cylindrical outer surface 44 to the bore 45. The cut-out has an angular extent, when the casting 40 is viewed axially, of 90°.

The cut-out, in the orientation of the casting as shown in FIG. 6, has a vertical face 49 and a horizontal face 50.

Co-aligned with the vertical face 49, on the opposite side of the axially extending bore 45, is a slot (not visible in the Figures), the slot being dimensioned to receive the wedge plate 41, when the wedge plate abuts the vertical face 49.

The wedge plate 41 is a plate having a linear side 51 and having formed therein an angularly inclined slot 52.

The wedge plate 41 is dimensioned to be received within the slot 37 formed in the bolt 30 and the pin 33 is dimensioned to be received within the slot 52 formed in the wedge plate 41.

In order to assemble the latch as thus far described, initially the bolt 30 is located in position in the axially extending bore 45, and the bolt is rotated so that the slot 37 is in a vertical position. The plate wedge 41 is then inserted into the slot 37, passing through the slot formed in the lower part of the casting 40. Finally, the pin 33 is introduced into the transverse bore 32 of the bolt 30, the pin also passing through the slot 52 in the wedge plate 41.

The latch is shown in an initial condition in FIG. 6. The wedge plate is in a lower-most position, that being the position that it will normally adopt under the influence of gravity when the latch is held in the orientation illustrated. In this position the bolt 30 is in a fully retracted position with the head 35 of the bolt being received within the recess 47. Thus the total dimension of the frame 20 provided with two latches such as the latch 25 will be the distance between the end faces 46 on the castings forming the latches. This distance may be made to be the desired spacing between the opposed faces of two legs enabling the frame to be offered up to the legs with a lateral movement.

When the head 35 of the bolt is aligned with a slot 6 as formed in the leg 1, the wedge plate 41 may be lifted, to a position as shown in FIG. 7. As the wedge plate is lifted, the pin 33 rides along the inclined slot 52, thus moving the bolt towards the right as illustrated in FIG. 6 and FIG. 7. The bolt is in such an orientation that the faces 38 and 39 formed on the head 35 of the bolt are vertical, and the distance between these faces is such that the head of the bolt may be introduced into the channel 15 formed behind the slot 6 in the leg 1.

When the bolt is in this condition the wedge plate 41 may be moved rotationally about the axis of the casting 40 as generally indicated by the arrow 52 in FIG. 7. The wedge plate then occupies the position illustrated in FIG. 8. Rotating the wedge plate 41 causes the bolt 30 to rotate since the wedge plate passes through the slot 37 defined in the bolt. This means that the head 35 of the bolt rotates through 90°. The flat under-surface 36 of the head of the bolt is thus opposed to the flat faces 11 and 12 defined by the inwardly directed lips 7 and 8 of the slot 5.

If the wedge plate 41 is then moved towards the right as shown in FIG. 8, as indicated by the arrow 54, the pin 33 will again be moved along the slot 52 in the wedge plate, thus tending to withdraw the bolt back into the casting 40. The flat under-surface 36 of the head of the bolt may thus be brought into secure engagement with the flat surfaces 11 and 12 defined by the inwardly directed lips 7 and 8 while the end face 46 of the casting is brought into firm engagement with the flat faces 9 and 10 defined by the outer faces of the inwardly directed lips 7 and 8. The wedge plate may be driven home, for example, with the assistance of a hammer, thus ensuring that a secure connection is established between the frame 20 and the extrusion 1.

When the frame is to be disengaged from the extrusion the end of the wedge plate projecting from the casting 40, in the position as illustrated in FIG. 8, may be struck with a hammer, thus tending to move the wedge plate towards the left as shown in FIG. 8 in the opposite direction to that indicated by the arrow 54. This will tend to loosen the connection enabling the wedge plate then to be rotated back to the vertical position of FIG. 7. The wedge plate may then be released. The wedge plate will drop under the force of gravity withdrawing the bolt from the channel 15, and returning the connector to the position illustrated in FIG. 6.

It is to be noted, from FIG. 7 and FIG. 8 that the end of the slot 52 formed in the wedge plate has a crook-shaped portion 55. Whilst it is intended that the connectors will be utilised in the orientation illustrated and described above, it is conceivable that the connectors may be used in an inverted position. If the connectors are used in such an inverted position instead of the wedge plate 41 automatically adopting the initial position as illustrated in FIG. 6, gravity will tend to cause the plate 41 to occupy an alternate position in which the bolt is in a projected position. However, if the connector is inverted the crook-shaped portion 54 of the slot 52 may be engaged with the pin to retain the wedge plate in an elevated position until the frame has been offered up to the legs to which the frame is to be connected. The plate 41 may then be moved to engage the pin 33 with the substantially linear portion of the slot 52, enabling the plate then to move transversely of the axis of the bore 45 formed in the casting 40 to move the bolt to a protracted position, equivalent to the position shown in FIG. 7.

It is to be appreciated that the casting 40 is securely connected to the exterior of the leg 1, and any forces experienced by the tube 21 or 22 connected to the casting 40 are transferred directly by the casting 40 and the associated bolt 30 to the leg 1, in a direction aligned with the axis of the tube 21 or 22.

In utilising a connector of the type described above it is only necessary to use a hammer, thus minimising the number of tools to be used by a scaffolder erecting a shoring system using legs, frames and connectors of the type described above.

What is claimed is:

1. A shoring system, the shoring system comprising at least two substantially vertical legs and at least one ledger frame extending between the legs, the ledger frame consisting of an upper horizontally extending member and a lower horizontally extending member the shoring system also comprising a first vertical member adjacent one side of the frame and a second vertical member adjacent the other side of the frame, the horizontal members extending beyond the vertical members and being provided with terminal connectors at ends of the horizontal members, the terminal connectors adapted to connect the horizontal members to the vertical legs, each terminal connector comprising a bolt having a head dimensioned in one orientation to enter through a slot in a channel defined by walls formed on a leg, and adapted to be moved to an alternative orientation in which it cannot be withdrawn from the channel, each terminal connector further comprising a bolt mover adapted to move the bolt to the said alternative orientation and to urge the bolt into firm contact with the walls defining the channel in the leg.

2. A shoring system according to claim 1 wherein the upper member and the lower member are both tubular.

3. A shoring system according to claim 1 wherein each connector comprises a spigot received within the end of the respective tubular member.

4. A shoring system according to claim 1 wherein each connector comprises an elongate housing to be mounted co-axially with the respective horizontal member, the housing defining a free end face and an axially extending bore, the bolt being received within the bore, the bolt mover being adapted to engage the housing and the bolt, to move the bolt axially, and to rotate the bolt.

5. A shoring system according to claim 1 wherein the bolt mover comprises a plate passing through a slot formed in the bolt, the plate having a slot form therein, a pin extending diametrically of the bolt passing through the slot in the plate, the plate being rotatable about the axis of the housing to rotate the bolt and being movable, in at least one orientation, transversely of the housing, the slot in the plate being designed to move the bolt axially in the housing in response to such transverse movement of the plate.

6. A shoring system according to claim 1 wherein the head of the bolt is substantially hemispherical and wherein the wails define a channel of substantially hemispherical cross-section.

7. A shoring system according to claim 1 wherein the free end face of the housing defines a rectangular recess adapted to receive the head of the bolt.

* * * * *